United States Patent [19]

Nordin

[11] 4,164,170

[45] Aug. 14, 1979

[54] METHOD OF MAKING BAGS

[75] Inventor: Kent A. R. Nordin, Rimbo, Sweden

[73] Assignee: Rimbo Tekniska Fabrik Rimpac AB, Rimbo, Sweden

[21] Appl. No.: 878,533

[22] Filed: Feb. 16, 1978

[30] Foreign Application Priority Data

Feb. 17, 1977 [SE] Sweden ..... 7701781
Mar. 30, 1977 [SE] Sweden ..... 7703719

[51] Int. Cl.[2] ..... B31B 49/04
[52] U.S. Cl. ..... 93/35 H; 93/35 R
[58] Field of Search ..... 93/35 H, 35 R, 33 H, 93/DIG. 1; 156/515

[56] References Cited

U.S. PATENT DOCUMENTS 2,903,947 9/1959 Weisshuhn ..... 93/35 R
3,548,723 12/1970 Sengewald ..... 93/35 H

FOREIGN PATENT DOCUMENTS 2133500 1/1973 Fed. Rep. of Germany ..... 93/35 H
2157073 5/1973 Fed. Rep. of Germany ..... 93/35 R

*Primary Examiner*—James F. Coan
*Attorney, Agent, or Firm*—Fred Philpitt

[57] ABSTRACT

There is provided a method of manufacturing a string of bags from a hose-like blank. The blank is cut along a wave-shape line substantially centrally between two opposed long edges of the blank, to form two blank-halves. Welds are made adjacent selected wave-tops and wave-bottoms of the wave-shape line to form bag handles, and further welds are made perpendicularly to said wave-shape line at selected distances apart to form said string of bags. Separation lines are made adjacent said further welds to bundle a bag to be separated from the string of bags thus formed.

10 Claims, 3 Drawing Figures

Figure 1:
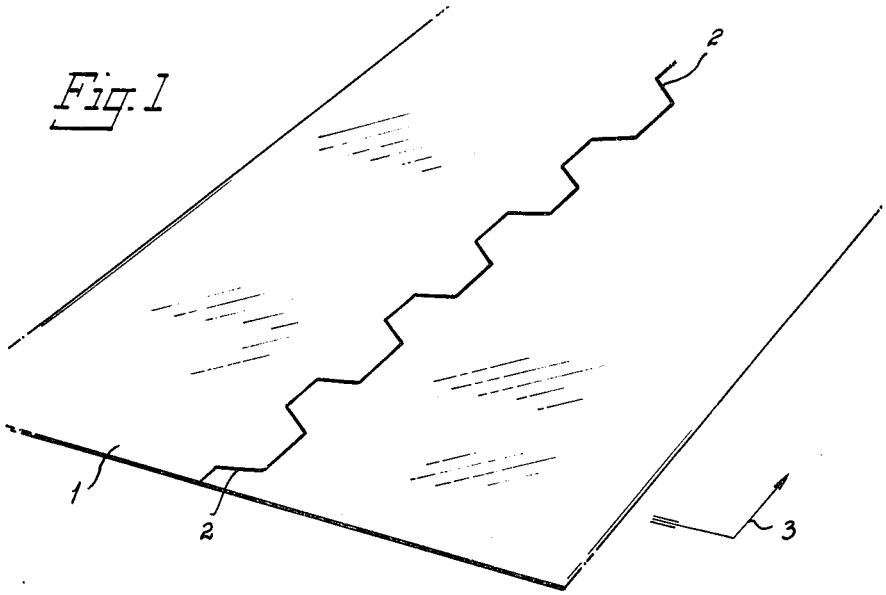

16
17
12
15
17
11
12
15
14
16

METHOD OF MAKING BAGS

The present invention relates to a bag-making method in which a string of bags separated by separation lines, such as tear lines, are produced from a blank comprising two layers of material, such as a plastics material, placed one upon the other and joined together, as by welding, along at least two edges thereof.

Such a method is known to the art. In the known method, the double-layer material blank is perforated along a line extending parallel to one side of the blank, and has preformed therein openings which correspond to the desired shape of the mouth of the bag. A disadvantage with this method, however, is that the material removed to form these openings goes to waste, this waste being quite considerable with time, with consequential disadvantages both/from an economic aspect and an aspect of waste disposal.

An object of the present invention is to provide a bag-making method in which the wastage caused by making the openings in the bag-blank is greatly reduced, thereby enabling the bags to be produced at reduced cost. According to one aspect this invention consists in a method of making a string of bags from a blank comprising two layers of material placed one upon the other and joined together along at least three edges thereof, said method comprising the steps of cutting the blank along a wave-shaped line parallel to a pair of mutually opposed edges of the blank and centrally therebetween, the wave-tops and wave-bottoms of said wave-shaped line being uniformly spaced apart; axially displacing the blank halves thus produced relative to one another in a manner such that a wave bottom coincides with an adjacent wave-top to form an opening of regular geometric shape; welding the material along a line extending centrally between adjacent openings thus formed to provide bag-handles; welding the material along further lines extending perpendicularly to said first-mentioned line, said further lines being uniformly spaced apart at a distance equal to the desired width of the bag; and providing separation-lines adjacent to and parallel with said further lines.

According to another aspect, this invention consists in a method of making a string of bags from a blank comprising two layers of material placed one upon the other and joined, as by welding, together along at least two edges thereof to form a hose, said method comprising the steps of cutting the blank along a line of wave-shape extending parallel to a pair of opposed edges, centrally therebetween, the wave-tops and wave-bottoms of said wave-shaped line being uniformly spaced apart; welding each of the blank halves thus formed along lines extending between two mutually adjacent wave-bottoms and through a wave-top on either side of the wave-shaped line adjacent thereto to form the handles of the bags; welding the material along further lines extending perpendicularly to said first-mentioned line and being uniformly spaced apart by a distance equal to the desired width of the bag; and by providing separation lines adjacent to and parallel with the aforementioned further lines.

Thus, by simply cutting the blank along a line of requisite wave-shape, i.e., a wave-shape which will provide the desired shape of the bag-opening, bag-openings can be made with far less waste of material than was possible with the known method.

Example of suitable wave-shapes include sinusoidal and square wave shapes. A preferred wave-shape is one in which the resultant opening have the form of a regular hexagon.

The width of the blank as seen at right angles to said wave-shaped line is suitably approximately twice the desired length of the bags so that two strings of bags joined by the aforementioned separation lines can be produced from each blank. Conveniently these separation lines are formed by perforating the blank along lines extending parallel to and lying adjacent to the lines along which the blank is sealed to form the sides of the bags.

Figure 2:
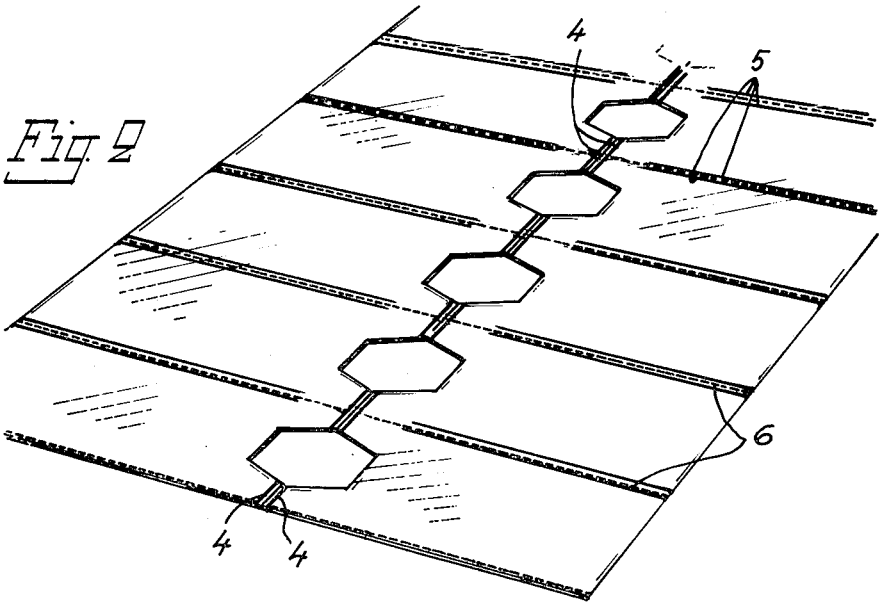
Figure 3:
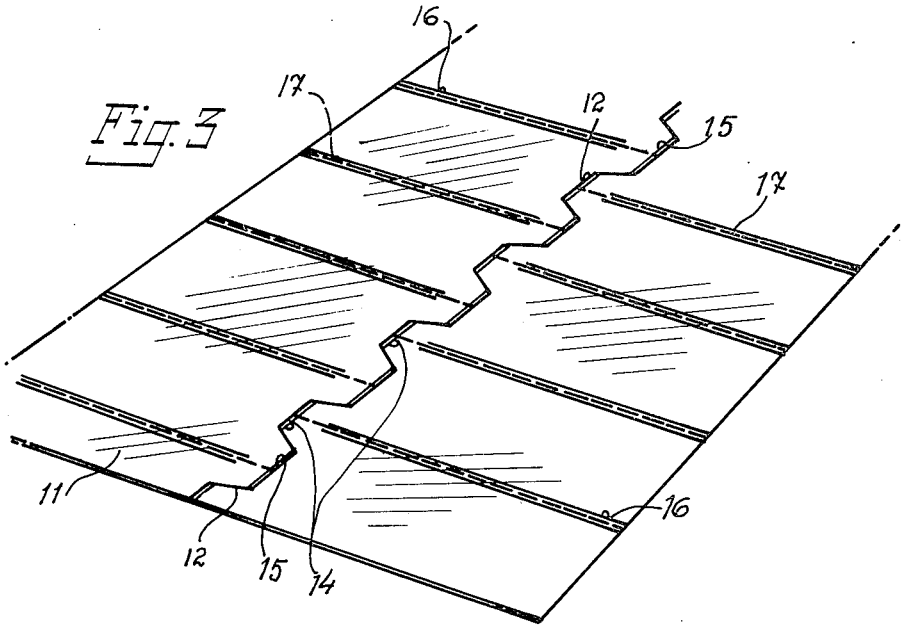

So that the invention will be more readily understood and further features thereof made apparent, the invention will now be described with reference to two exemplary embodiments thereof illustrated schematically in the accompanying drawing, in which FIG. 1 illustrates a bag-blank which has been cut along a line of wave-shape provided openings of hexagonal configuration, FIG. 2 shows the blank halves of the FIG. 1 embodiment displaced axially relative to one another, so that the wave bottom of one blank half coincides with the wave top of the other blank half, and FIG. 3 illustrates a further blank from which bags can be made according to an alternative embodiment of the invention. Referring now to FIG. 1, there is illustrated a bag-blank comprising two sheets 1 placed one upon the other and welded along at least three edges thereof. The blank is cut completely through, along a line 2 extending centrally between two opposing long sides of the blank, the shape of the cut being such as to provide a bag-opening of the desired configuration. As will be evident from the figure, the cut-shape is one where adjacent sections are the mirror image of each other, where the crests and bottoms of said cut-shape have a uniform pitch. For the sake of convenience the cut line will be referred to hereinafter as the line of wave-shape.

In the method shown in FIGS. 1 and 2, subsequent to making the cut 2, the two blank halves thus produced are moved apart and one blank half is displaced axially relative to the other, as indicated by the arrow 3, in a manner such that a wave-bottom lies in register with an adjacent wave-tope, to provide a row of openings of the desired shape.

FIG. 2 shows the blank subsequent to moving the severed blank halves axially, to form the moulds of the bags. The two layers 1 of the two blank halves are then welded together along lines 4 extending between adjacent openings and between the two outer edges of the blank and respective openings nearest thereto. The welds along lines 4 join the layers of material 1 together, to form the handles of a finished bag. The layers of material 1 are also welded together along lines 5 extending in uniform spaced relationship at right angles to the lines 4, the spacing between the lines 5 being equal to the desired width of the bag. As shown in FIG. 2, the welds 5 do not extend up to the lines 4, but terminate at a distance therefrom, so that the unwelded material, together with the welds 4, form the handles of a finished bag.

Extending close to and parallel with the welds 5 are separation lines 6, these lines conveniently comprising a multiplicity of perforations or lines along which the material has been weakened, thereby to enable one bag to be readily separated from another. As will readily be understood, the separation line 6 will extend across the whole width of the blank.

The thus produced string of bags, each of which is joined to an adjacent bag by respective separation lines, can be rolled up on storage rollers or the like, ready for shipment and immediate use.

Although the aforedescribed method of producing strings of bags represents a step forward in the art, it is possible, in accordance with a further aspect of the invention, to provide a string of bags from a blank without displacing the severed halves of the blank axially relative to one another. This alternative method of the invention is illustrated in FIG. 3.

Thus, FIG. 3 illustrates a bag-blank comprising two sheets 11 of material, such as a plastics material, placed one upon the other and joined, e.g. heat-welded, along two mutually opposite longsides thereof, to form a hose. As with the method described with reference to FIGS. 1 and 2, the blank is cut along a line 12 extending substantially centrally of the said two mutually opposite longsides of the blank, the shape of said line being selected in dependence upon the desired shape of the bag opening, such that adjacent sections of the line are mirror images of each other and the wave-tops and wave-bottoms of the line are of equal pitch and slope.

Subsequent to cutting the hose-like blank into two substantially equal parts along the line 12, the two layers 11 of material forming the two blank halves are joined together along lines 14 and 15 extending adjacent to and parallel with the lines defining the wave-tops of each alternate wave on both sides of the wave-like cutting line 12, with an interruption at those parts of the lines which cut the wave-tops on the other side of the said wave-shaped cutting line. Thus, the lines 15 will be located on the left-hand side of the cutting line 12 whilst the lines 14 will extend on the right-hand side of said line.

The layers of material 11 are also welded together along lines 16 extending in uniform spaced relationship at right angles to the lines 14 and 15, the spacing between the lines 16 being equal to the desired width of the bag. As illustrated in FIG. 3, the welds 16 do not extend up to respective lines 14 and 15, but terminate at a distance therefrom, so that the unwelded material, together with the weld lines 14 and 15, form the handles of a finished bag. Extending parallel to the welds 15 are separation lines 17, which may comprise a plurality of perforations or lines along which the material has been weakened, thereby to enable the bags to be separated one from the other. It will be seen that the separation lines 17 extend over the whole width of the hose half obtained when cutting the blank along the wave-shaped cutting line.

The order in which the steps of cutting, welding and perforating the blank are carried out is not critical. For example it is possible to make the welds in a first operation and to perforate and cut the blank in a second and third operation respectively.

The strings of bags thus obtained, in which the bags are joined together by separation lines, can be rolled onto storage rolls or the like, ready for shipment and immediate use.

What is claimed is:

1. A method of making a string of bags from a blank comprising two layers of material joined together along at least three edges thereof, said method comprising the steps of cutting the layers of material along a line of wave-shape extending parallel to a pair of opposed edges, substantially centrally therebetween, the wave-tops and wave-bottoms of said wave-shape being uniformly spaced apart; displacing the thus obtained blank halves axially relative to one another in a manner such that a wave-bottom coincides with an adjacent wave-top to form an opening of regular geometric shape; welding the material along a line extending centrally between adjacent openings to form bag handles; welding the material along further lines extending perpendicularly to said firstmentioned line and being uniformly spaced apart by a distance equal to the desired width of the bag; and providing separation lines adjacent to and parallel with said further lines.

2. A method according to claim 1, wherein the wave-shape is sinusoidal to provide circular openings.

3. A method according to claim 1, wherein the wave-shape is such as to provide openings having the shape of a regular hexagon.

4. A method according to claim 1, wherein the separation lines are formed by perforating the bag material along lines extending parallel and adjacent to said further lines.

5. A method according to claim 1, wherein the width of the material seen at right angles to the wave-shaped line is twice the length of a bag.

6. A method according to claim 1, wherein said further lines terminate at a given distance from said wave-shaped line.

7. A method of making a string of bags from a blank comprising two layers of material placed one upon the other and joined, as by welding, together along at least two edges thereof to form a hose, said method comprising the steps of cutting the blank along a line of wave-shape extending parallel to a pair of opposed edges, centrally therebetween, the wave-tops and wave-bottoms of said wave-shaped line being uniformly spaced apart; welding each of the blank halves thus formed along a first line between mutually adjacent wave-bottoms and a second line between mutually adjacent wave-tops, said first line being on one side of the line of wave-shape and adjacent thereto and said second line being on the other side of said line of wave-shape and adjacent thereto to form the handles of the bags; welding the material along further lines extending perpendicularly to said first and second line and being uniformly spaced apart by a distance equal to the desired width of the bag; and by providing separation lines adjacent to and parallel with the aforementioned further lines.

8. A method according to claim 7, wherein the separation lines are formed by perforating the bag material along lines extending parallel and adjacent to said further lines.

9. A method according to claim 7, wherein the width of the material seen at right angles to the wave-shaped line is twice the length of a bag.

10. A method according to claim 7, wherein said further lines terminate at a given distance from said wave-shaped line.

* * * * *